US006878046B2

(12) United States Patent
Publ et al.

(10) Patent No.: US 6,878,046 B2
(45) Date of Patent: Apr. 12, 2005

(54) CLEANING APPARATUS

(75) Inventors: Rudy Publ, Glendale Heights, IL (US); Brian Gutkowski, Willowbrook, IL (US)

(73) Assignee: Safety-Kleen Systems, Inc., Columbia, SC (US)

( * ) Notice: Subject to any disclaimer, the term of this patent is extended or adjusted under 35 U.S.C. 154(b) by 121 days.

(21) Appl. No.: 10/290,673

(22) Filed: Nov. 8, 2002

(65) Prior Publication Data

US 2004/0092216 A1 May 13, 2004

(51) Int. Cl.[7] ..... B24B 1/00

(52) U.S. Cl. ..... 451/89; 451/36; 451/38; 451/75; 451/87; 451/88; 451/90

(58) Field of Search ..... 451/36, 38, 75, 451/87, 88, 89, 90

(56) References Cited

U.S. PATENT DOCUMENTS

| | | | | |
|---|---|---|---|---|
| 795,412 | A | 7/1905 | Olson | |
| 866,804 | A | 9/1907 | Olson | |
| 975,782 | A | 11/1910 | Mott | |
| 1,037,824 | A | 9/1912 | Fasting | |
| 1,671,025 | A | 3/1928 | Franzmeier | |
| 1,813,637 | A | 9/1931 | Powers | |
| 2,943,698 | A | 3/1960 | Bishop | |
| 3,368,181 | A | 2/1968 | Myers | |
| 3,543,325 | A | 12/1970 | Hamrick | |
| 3,802,570 | A | 4/1974 | Dahne | |
| 4,111,005 | A | 9/1978 | Livesay | |
| 4,133,658 | A | 1/1979 | Callewyn | |
| 4,185,354 | A | 1/1980 | Brazier | |
| 4,192,429 | A | 3/1980 | Yerman | |
| 4,199,960 | A | 4/1980 | Adams et al. | |
| 4,511,291 | A | 4/1985 | Quates, Sr. et al. | |
| 4,731,101 | A | 3/1988 | Kanda | |
| 4,765,779 | A | 8/1988 | Organ | |
| 5,031,790 | A | 7/1991 | Keller | |
| 5,251,776 | A | 10/1993 | Morgan, Jr. et al. | |
| 5,325,977 | A | 7/1994 | Hayes et al. | |
| 5,462,186 | A | 10/1995 | Ladina et al. | |
| 5,579,811 | A | 12/1996 | Hsu | |
| 5,603,425 | A | 2/1997 | Breeden | |
| 5,607,000 | A | 3/1997 | Cripe et al. | |
| 5,615,716 | A | 4/1997 | Akazawa | |
| 5,653,316 | A | 8/1997 | Kane | |
| 5,682,929 | A | 11/1997 | Maginot et al. | |
| 5,874,296 | A | 2/1999 | Kang | |
| 6,036,045 | A | 3/2000 | West | |
| 6,045,000 | A | 4/2000 | Rauworth et al. | |
| 6,105,811 | A | 8/2000 | Alfred | |
| 6,149,345 | A | 11/2000 | Atkins | |
| 6,171,356 | B1 | 1/2001 | Twerdun | |
| 6,221,134 | B1 | 4/2001 | Conrad et al. | |
| 6,227,391 | B1 | 5/2001 | King | |
| 6,237,186 | B1 | 5/2001 | Griffiths | |
| 6,364,748 | B1 * | 4/2002 | Zwicker et al. | 451/38 |
| 6,712,677 | B2 * | 3/2004 | Williams et al. | 451/89 |

* cited by examiner

*Primary Examiner*—Lee D. Wilson
*Assistant Examiner*—Shantese McDonald
(74) *Attorney, Agent, or Firm*—Vedder, Price, Kaufman & Kammholz, P.C.

(57) ABSTRACT

An apparatus for cleaning using blast cleaning media including a cabinet, an evacuation device in communication with the cabinet, and a delivery unit containing cleaning media in communication with the cabinet. The delivery unit includes a safety device for relieving pressure within the delivery unit prior to refilling. The cabinet includes ports in communication with a diverter channel for increasing visibility along a line of sight upon activation of the evacuation device.

27 Claims, 7 Drawing Sheets

CLEANING APPARATUS

CROSS-REFERENCE TO RELATED APPLICATION

This application claims the benefit of U.S. Provisional Application Ser. No. 60/344,751, filed Nov. 9, 2001, entitled "Apparatus For Cleaning".

BACKGROUND OF THE INVENTION

This invention pertains to an apparatus for cleaning parts, and more particularly, to an apparatus using a media blasting system to remove dirt, scale, lime, rust, coatings or any other surface contaminant from an object.

Media blasting systems are known in the art. Specifically, systems which include a cabinet, an evacuation device and a delivery unit have been used for years. However, certain disadvantages of the prior art systems remain. One such disadvantage is a clear line of sight into the blasting cabinet. Visibility along the line of sight provided by a glass covered opening in prior art devices is often obscured by the blast media and debris swirling around in the blast cabinet. As a result, the operators line of sight is often obscured enough to slow the progress of work and effect the operators productivity.

Another disadvantage of prior art blast systems is related to the refilling of the delivery unit. Usually the delivery unit is operated under pressure in order to facilitate blast media flow. This pressure must be relieved before the delivery unit can be refilled. In a properly designed blast media cabinet system, an apparatus for relieving the pressure associated with the delivery unit is usually provided. However, many times this important step in the process is overlooked and the delivery unit remains under pressure when the refill port is accessed by the operator. As a result, the operator is often injured when the refill port cover is propelled from the delivery unit by the pressure contained therein. As a result, costs increase, productivity decreases and the employer is faced with another worker's compensation claim.

Yet another disadvantage of prior art blast media cabinet systems is the actual refilling of the delivery unit. The conventional method for refilling is to cut open the bag of blast media and dump the blast media into the delivery unit. As a result of this crude process, blast media is distributed about the workplace. Consequently, there is a hazardous situation in which other workers may be injured or potentially placed at significant risk. Further, product loss is considerable which results in higher costs of operation.

Therefore, there is a significant need and demand for a cleaning apparatus which provides the advantages of a clear line of sight, a safety pressure relief, effective blast media transfer, decreased costs and increased productivity.

BRIEF DESCRIPTION OF THE DRAWINGS

In the course of the following detailed description, reference will be made to the attached drawings wherein like reference numerals identify like parts and in which.

DETAILED DESCRIPTION OF A PREFERRED EMBODIMENT OF THE INVENTION

Figure 1:
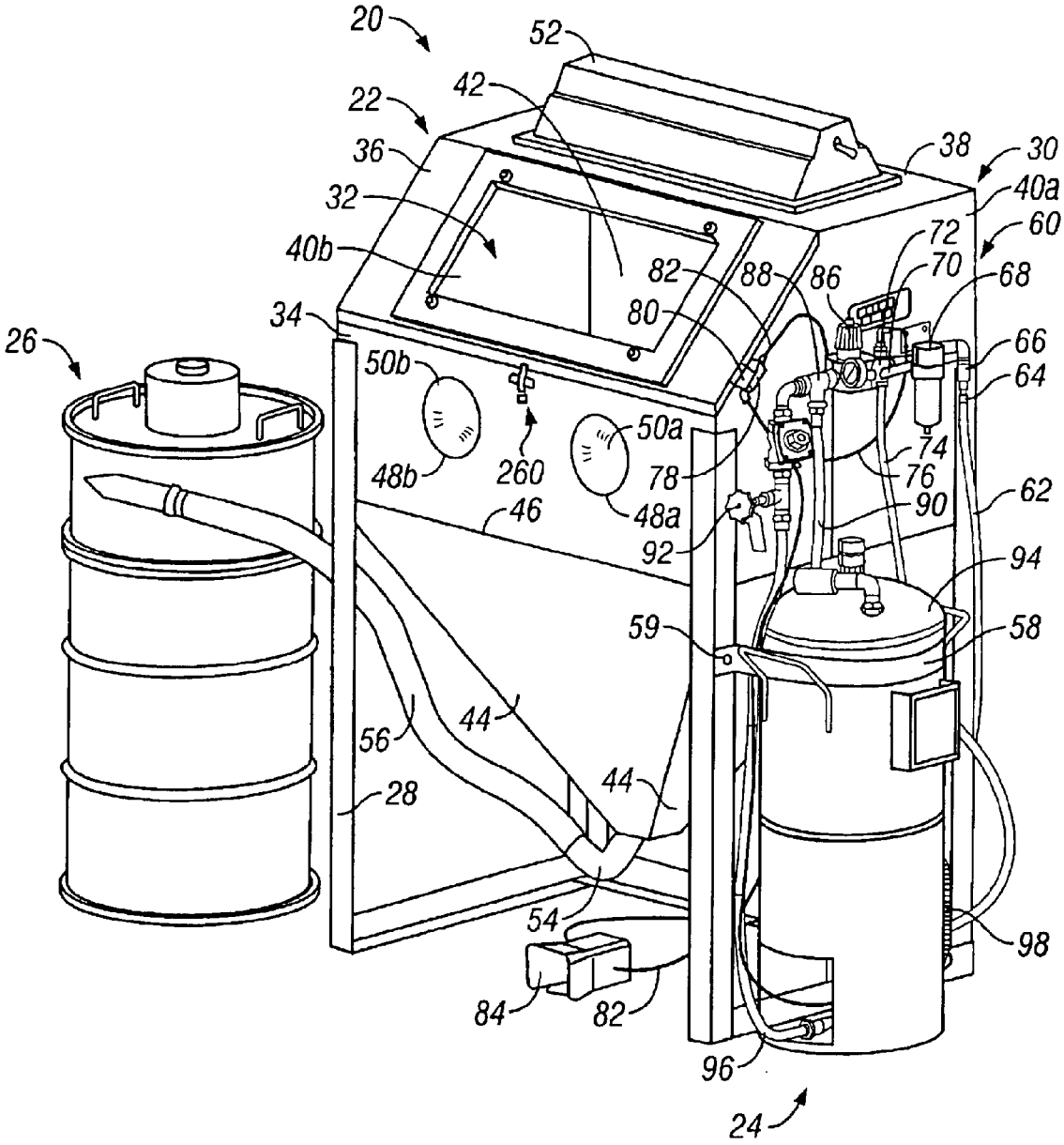
FIG. 1 is a perspective view of the cleaning apparatus in accordance with the principles of the present invention.

One principle aspect of the present invention is directed to an apparatus for a cleaning process including a cabinet having an access panel and a removable cover and an evacuation device. The cabinet is operatively connected to a delivery unit for holding and supplying cleaning media and an evacuation device for collecting used cleaning media and debris generated during the cleaning process. The cabinet includes a support structure and a plurality of panels defining a cleaning chamber and a hopper separated by a shelf. One of the plurality of panels is configured as an access panel and includes a viewing aperture and at least one port formed adjacent the viewing aperture. A cover including a transparent element and an overhanging portion is removably connected to the access panel such that the transparent element is aligned with the viewing aperture to provide a line of sight. A gasket is disposed on the cover for contact with the access panel to seal the cover and the access panel interface. The overhanging portion includes a portion which is discontiguous with the access panel and defines a gap when the cover is removably connected to the access panel. The evacuation device is activated during the cleaning process to remove used cleaning media and debris from the cabinet by drawing air through the gap and each at least one port, whereby visibility along the line of sight is increased.

In another principle aspect of the present invention, a blast cabinet cleaning apparatus includes a delivery unit. The delivery unit includes a container for blast media having a refill port and a safety device. The safety device is operatively connected to the refill port for relieving pressure in the container. The refill port is adapted for operative connection to a media source for refilling the container with cleaning media. The refill port includes a wall configured to define a bore. The wall has an outer surface which includes a coupling element formed thereon. The wall further has an inner surface including a first connection element formed thereon. The safety device includes a head and a shaft extending from the head at a shoulder. The shaft further includes a second connection element complementary to the first connection element, a bore, and at least one vent. The bore extends through the shaft from a free end of the shaft to an inner end adjacent the shoulder. Each at least one vent is disposed adjacent the inner end extending from the bore through a wall of the shaft. The safety device relieves pressure in the container when the safety device is partially disengaged from the refill port such that each at least one vent is exposed to enable communication between the pressurized container and an environment exterior of the safety device.

Yet another principle aspect of the present invention is directed to a blast cabinet cleaning apparatus including a media transfer system for refilling a delivery unit. The media transfer system includes a cleaning media source, the delivery unit, and a conduit operatively connecting the cleaning media source to the delivery unit. The delivery unit includes a container having a refill port and a vacuum port. The delivery unit further includes a safety device operatively connected to the refill port for relieving pressure in the container when the safety device is partially disconnected from the refill port. The conduit operatively connects the cleaning media source to the refill port after the safety device has been removed. A vacuum source is operatively connected to the vacuum port. A vacuum generated by the vacuum source draws media from the media source, through the conduit and refill port and into the delivery unit.

FIG. 1 illustrates a perspective view of the cleaning apparatus in accordance with the principles of the present invention. A cleaning media blasting apparatus 20 configured in accordance with one embodiment of the present invention includes three main components, namely, a cabinet 22, a delivery unit 24 and an evacuation unit 26. The cabinet 22 is operatively connected to the delivery unit 24 which contains and supplies the cleaning media and the evacuation device 26 which collects the used cleaning media and debris generated during the cleaning process.

The cabinet 22 includes a support structure 28 and a plurality of panels 30 which define a cleaning chamber 32 disposed above a hopper and separated by a shelf (not shown in this FIG. 1). The support structure 28 generally includes a plurality of elements joined to support the cleaning chamber 32 and hopper at a comfortable working level. The elements in this embodiment of the present invention are preferably conventional right angle metal stock. The material of construction for the elements is preferably a ferrous or non-ferrous material. However, it is within the teachings of the present invention that the elements may be formed of any suitable material and in any suitable shape so as to provide adequate support for the cleaning chamber and receptacle. For example, the elements may be formed of any plastic, alloy, engineered material, or any other suitable material and may have a flat, rectangular, tubular, or any other suitable configuration.

The plurality of panels 30 generally include a front panel 34, an access panel 36, a top panel 38, a pair of side panels 40*a*, 40*b*, a rear panel 42 and a plurality of hopper panels 44 (only the front and one side of which are shown).

The cleaning chamber 32 is defined by the front panel 34, access panel 36, top panel 38, side panels 40*a*, 40*b* and rear panel 42. The hopper is defined by the hopper panels 44. A shelf (not shown in this FIG. 1) is generally disposed in a horizontal position in the cabinet 22 between the cleaning chamber 32 and the hopper. Preferably, the shelf (not shown in this FIG. 1) is generally disposed at a level indicated by the line 46 separating the front panel 34 from the hopper panel 44. Further, the shelf preferably has a wire form construction sufficient to support objects to be cleaned while permitting the cleaning media and debris to be drawn from the cleaning chamber 32 and the hopper into the evacuation device 26.

The front panel 34 includes a pair of apertures 48*a*, 48*b* which are connected to gloves 50*a*, 50*b* which are disposed within the cleaning chamber 32. An operator inserts his hands through the apertures 48*a*, 48*b* into the gloves 50*a*, 50*b* in order to manipulate a gun-type or nozzle-type device (not shown in this FIG. 1) disposed inside the cleaning chamber 32 which directs the flow of blast cleaning media as desired. Preferably, the gloves 50*a*, 50*b* are conventional in design and material. However, it is within the teachings of the present invention that the gloves 50*a*, 50*b* may be configured in any suitable design from any suitable material for use in a particular cleaning process. For example, the gloves may be formed from rubber, leather, an elastomeric material, an abrasion-resistant material or any other material suitable for use in a blasting cleaning process.

The access panel 36 includes a viewing aperture and at least one port formed adjacent the viewing aperture as will be described in detail in connection with FIG. 2. The access panel 36 is moveably connected to the cabinet 22 such that it pivots about its top edge. A latch assembly 260 is partly disposed on the access panel 36 and the front panel 34 to secure the access panel 36 in a closed position, as shown.

The top panel 38 includes an aperture (not shown in this FIG. 1) formed therein and a light fixture 52 disposed thereon in communication with the aperture. The light fixture 52 is preferably a conventional fluorescent light fixture. However, it is within the teaching of the present invention that the light fixture 52 may be configured as any conventional lighting apparatus. For example, an incandescent, metal-halide, zenon-arc, halogen or other suitable lighting apparatus may be used.

An outlet 54 is disposed at the lower end of the hopper for connection with a hose 56 so that the evacuation device 26 is in communication with the cleaning chamber 32 and the hopper in order to generate a vacuum therein as will be described in detail below.

The delivery unit 24 is preferably connected to the cabinet 22 by a bandstrap 58 and appropriate fasteners 59. Preferably, the bandstrap is made from metal or another suitable material having similar strength and other associated properties and the fasteners include a stud and wing nut assembly which capture the bandstrap between the wing nut and the linear element support member 28. It will be recognized by those of skill in the art that any other suitable assembly of parts may be used to connect the delivery unit 24 to the cabinet 22 for use as described herein.

Blast media is loaded into the delivery unit 24 as will be discussed below with regard to FIGS. 8 and 9.

A control assembly 60 is disposed on a side panel 40*a* of the cabinet 22. A pneumatic source is connected to the control assembly 60 by a hose 62. The pneumatic source may be from any available external source, such as shop air or a small adjacently disposed compressor which is configured to meet the system airflow requirements. The hose 62 includes a quick disconnect fitting 64 which engages a complementary quick disconnect fitting 66 of the control assembly 60.

The compressed air from the pneumatic source passes through an debris/water separator 68. A ball valve 70 or other suitable device for controlling the flow of air through the control system 60 is in communication with an outlet of the air/water separator 68. A fitting 72 is connected to an outlet of the valve 70. The lower port of the fitting provides air pressure via a hose 74 to a gun-type device (not shown) disposed within the cabinet for general purpose blast media removal from parts being cleaned. The upper port of the fitting 72 is in communication with a hose 76 which routes the compressed air through a cabinet interlock switch 78.

The cabinet interlock switch 78 includes a plunger (not shown in this FIG. 1) which contacts a flange 80 on the access panel such that if the access panel 36 is disposed in an open position, the control system 60 is inoperative. Another hose 82 extends from the cabinet interlock switch 80 to the footswitch 84 which ultimately controls the discharge of blast media from the delivery unit 24 to the gun-type or nozzle-type delivery device (not shown in this FIG. 1) disposed within the cabinet 22, as will be discussed in detail below.

A pressure regulator 86 is connected to the middle port of the fitting 72 for controlling and adjusting the compressed air pressure within the remainder of the control system 60. A T-fitting 88 is connected to the air pressure regulator 86 for directing regulated air to the delivery unit 24 via hose 90 and a differential pressure gate valve 92. The hose 90 is connected to a port disposed on an upper surface 94 of the delivery unit 24 so that compressed air supplied to a space above the cleaning media inside the delivery unit 24 pressurizes such space and cleaning media. A hose 96 connects the differential gate valve 92 to a T-fitting disposed below the container of the delivery unit 24 for forcing the blast media through a hose 98 through the gun-type nozzle-type device disposed within the cleaning chamber 32 as will be discussed below in detail.

Figure 2:
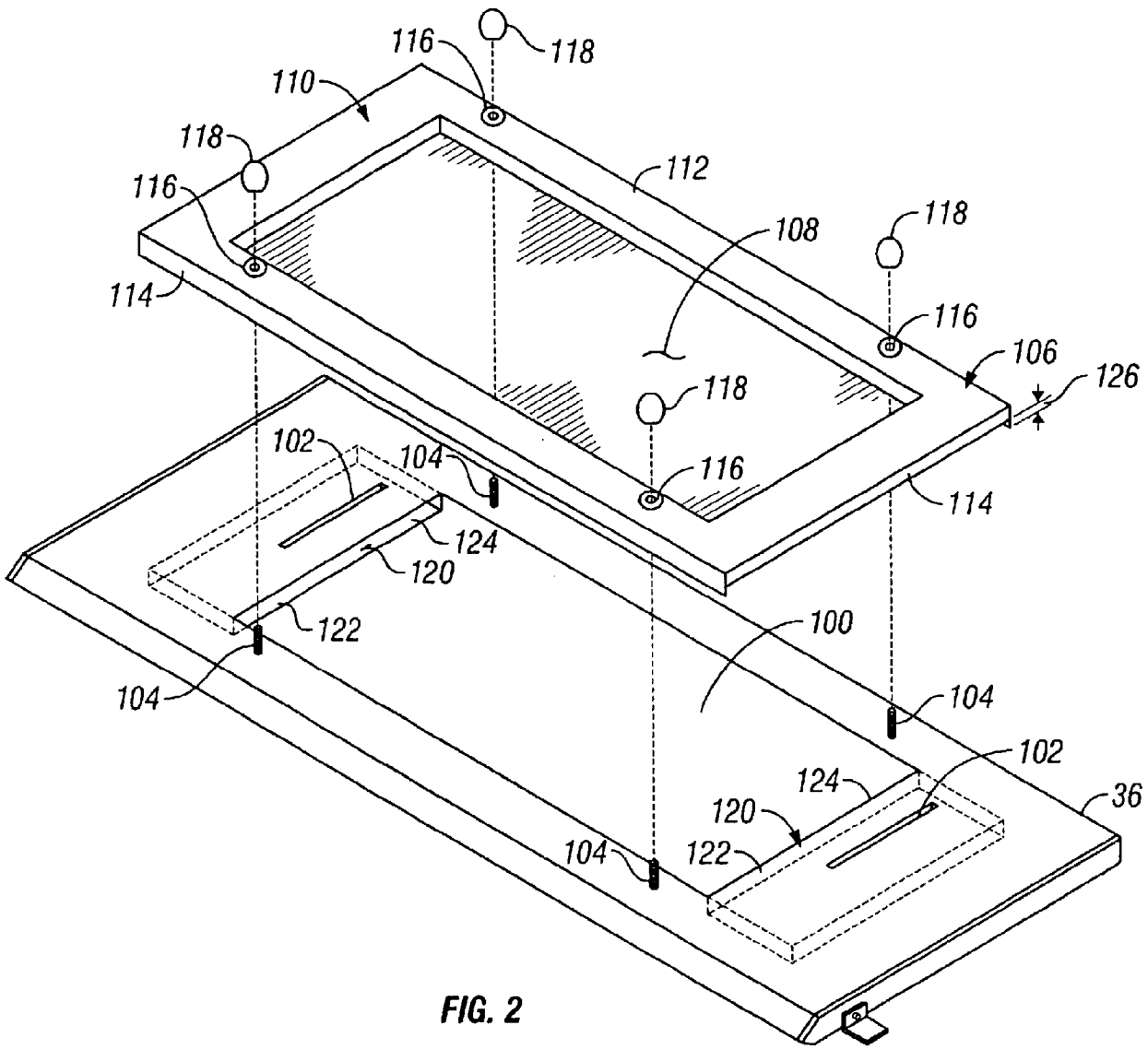
FIG. 2 is an exploded view of the access panel of the cleaning apparatus of FIG. 1.

FIG. 2 illustrates an exploded detail view of the access panel 36 of the cleaning apparatus shown and described in FIG. 1. The access panel 36 includes a viewing aperture 100 and at least one port 102 formed in the access panel adjacent the viewing aperture 100. A plurality of threaded studs 104 are connected to the access panel 36 in order to connect a cover 106 to the access panel 36. The cover 106 includes a transparent element 108 and an overhanging portion 110 which may be generally described as the top element 112 and all depending elements 114 extending away from the transparent element 108. A plurality of apertures 116 are formed in the top element 112 for engaging the threaded studs 104 such that the cover 106 may be removably connected to the access panel 36. A plurality of knobs 118 each have a threaded receptacle (not shown in this FIG. 2) configured for complementary engagement with the threaded studs 104 in order to secure the cover to the access panel. It will be recognized by those of skill in the art that other suitable complementary connecting apparatus and devices may be used with this present invention.

The cover 106 is removably connected to the access panel 36 such that the transparent element 108 is aligned with the viewing aperture 100 in order to provide a line of sight therethrough. A gasket (not shown in this FIG. 2) is disposed on the bottom surface of the top element 112 for contact with the access panel 36 to seal the cover/access panel interface.

The access panel 36 further includes a diverter channel 120 disposed on the bottom thereof, as primarily shown in phantom in this FIG. 2. The diverter channel 120 has an opening 122 disposed immediately adjacent an edge 124 of the viewing aperture 100. Each diverter channel 120 is disposed on the access panel 36 such that each at least one port 102 is in communication therewith. The overhanging portion 110 includes at least one element discontiguous with the access panel 36 when the cover is connected thereto which defines a gap 126. In this embodiment of the present invention, at least one depending element 114 depends a distance from the top element 112 less than adjacent depending elements 114.

Activation of the evacuation device during the cleaning process removes used cleaning media and debris from the cabinet by drawing air through the gap 126 and each at least one port 102, whereby visibility along the line of sight is increased. The air drawn through the gap 126 and each at least one port 102 enters the diverter channel 120 and is redirected through the opening 122 such that the air travels across the transparent element 108 before being drawn downward into the receptacle in the direction of the evacuation device. Accordingly, a consistent flow of air passes across the transparent element 108 such that the used cleaning media and debris are drawn away from the line of sight. Therefore, the disadvantage of the prior art regarding poor visibility within the cleaning chamber is overcome.

Figure 3:
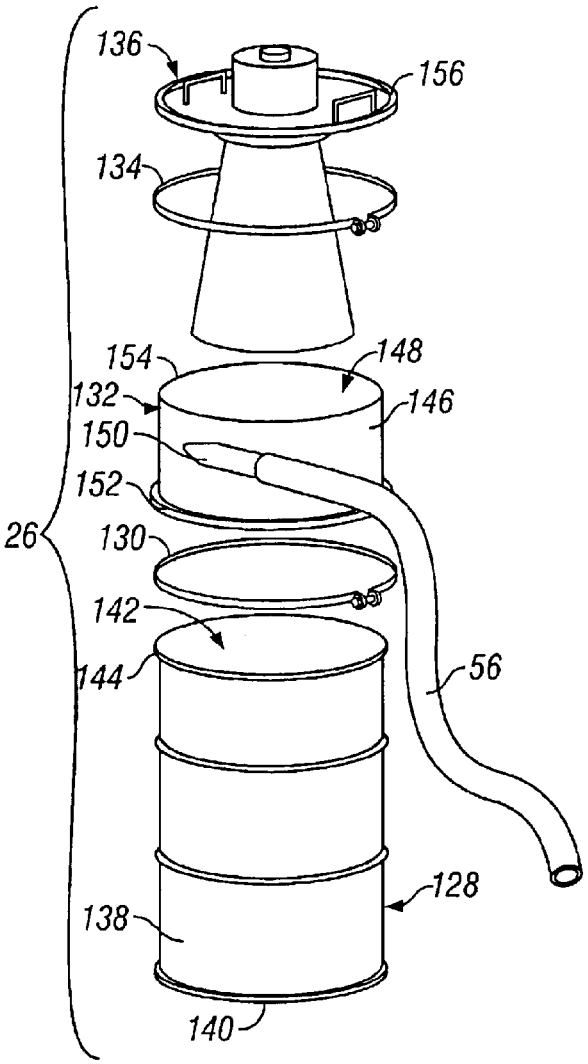
FIG. 3 is an exploded view of the evacuation device of the cleaning apparatus of FIG. 1.

FIG. 3 illustrates an exploded view of the evacuation device 26 of the cleaning apparatus of FIG. 1. The evacuation device 26 includes a base container 128, a first bolt ring assembly 130, a transition collar 132, a second bolt ring assembly 134 and a power head assembly 136.

The base container 128 includes a wall 138 and a bottom 140 which define a receptacle 142. A rim 144 is formed at the upper edge of the wall 138.

The transition collar 132 includes a wall 146 which defines a bore 148. The transition collar 146 further includes an air inlet port 150 disposed on one side of the transition collar 132 such that the inlet port 150 is oriented tangential to the transition collar 132. The hose 56 is connected to the inlet port 150 by any conventional apparatus or device, such as a hose clamp or friction fit. A longitudinal axis of the inlet tube 150 is oriented perpendicular to the longitudinal axis extending through the transition collar 132 and the base container 128. A lower rim 152 is formed on the lower edge of the wall 146 and an upper rim 154 is formed on an upper edge of the wall 146.

The transition collar 132 is connected to the base container 128 by abutting the lower rim 152 and the upper rim 144 such that the bolt ring assembly 130 may engage both rims securely. It is within the teaching so the present invention that a gasket may be used in connection with the mating surfaces of the base container, transition collar and power head assembly.

The power head assembly 136 is connected to the transition collar 146 in a similar manner. A rim 156 of the power head assembly 136 is disposed abutting the upper rim 154 of the transition collar 146 such that the bolt ring assembly 134 engages both securely. When assembled in this manner, air enters the evacuation device only through the hose 56.

The material of construction of each element of the evacuation device may be of any conventional well-known material suitable for the purpose, such as metal or high strength plastic for the base container, transition collar, power head assembly and bolt ring assemblies, or some flexible, elastomeric material for the hose.

Figure 4:
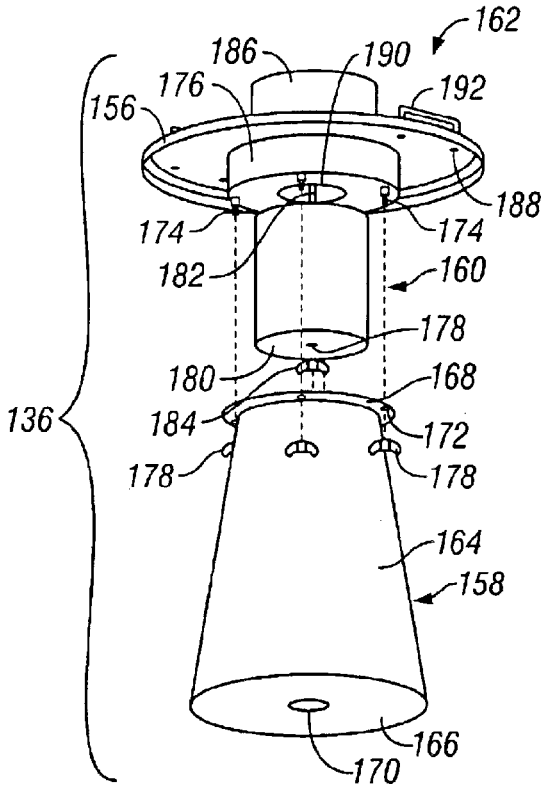
FIG. 4 is an exploded view of the power head assembly and filtering device of the evacuation unit of FIG. 3.

FIG. 4 illustrates an exploded view of the power head assembly 136 of the evacuation unit shown in FIG. 3. The power head assembly 136 includes a cone 158, a filter 160 and a cover assembly 162.

The cone 158 includes a side wall 164, a bottom wall 166 and a mounting flange 168 which cooperatively define a receptacle for receiving the filter 160. The bottom wall 166 has an inlet aperture 170 formed therein such that air may pass therethrough. The mounting flange 168 includes a plurality of apertures 172 formed therein to receive threaded studs 174 attached to a blower 176 for connecting the cone 158 to the blower 176. Wing nuts 178 engage the studs 174 after the cone 158 has been properly positioned and secure the cone 158 to the blower 176.

Before the cone 158 is attached to the blower 176, the filter 160 is attached to the blower 176. Preferably, the filter 160 includes an aperture in a lower end 180 which engages a threaded rod 182 so that a wing nut 184 may secure the filter 160 to the blower 176.

The cover assembly 162 includes the blower 176, a motor 186 and a lid 188. The blower 176 is connected to the lid 188 in any conventional manner. The motor 186 is operatively connected to the blower 176 in order to provide rotative movement therefor. The blower 176 includes an inlet aperture 190 such that when rotative movement is applied thereto, air is drawn through the inlet aperture 190, filter 160, cone aperture 170, inlet port 150 and associated hose 56. This same action draws air through the cabinet including the diverter channels and the ports associated therewith. The lid 188 includes a rim 156 and a plurality of handles 192.

It will be recognized by those of skill in the art that the cone 158 may be formed from any suitable material. For example, the cone may be formed from a metal, plastic, mesh, filter, combination of any of the aforementioned or any other suitable material. When the cone 158 is formed of a substantially solid or impermeable material, the aperture 170 in the bottom wall 166 allows air to be drawn into the cone and filtered by the filter 160 for discharge into the atmosphere. A cone made of semi-permeable or filter-type material performs an initial or preliminary filtering function in addition to the filter 160.

In operation, air is drawn into the evacuation device 26 through the tangential air inlet port 150 so that the air moves in a cyclonic or circular motion within the base container 128 such that used cleaning media and debris is disposed around the inner perimeter of the base container 128. As more air is drawn into the base container 128, the tapered surface of the inverted cone 158 forces the air, used cleaning media and debris combination towards the wall 138 of the base container 128. As the air, used cleaning media and debris combination is forced downward, velocity of such is increased as a result of the decreased area between the cone side wall 164 and the wall 138 of the base container 128.

The air, used cleaning media and debris combination is discharged past the lower edge of the cone 158, so that the used cleaning media and debris is forced to the bottom wall 140 of the base container 128. The air is then drawn through the aperture 170 of the cone 158 and the filter 160 to be discharged into the atmosphere.

Separation of the used cleaning media and debris from the air increases the efficiency of the evacuation device 26 and reduces the required filter 160 surface area. Accordingly, a more compact design is available. In this embodiment, more than 80 pounds of used blast media and debris may be efficiently collected in the evacuation device 26 prior to servicing. It will be recognized that any blast cleaning media may be used, such as baking soda, walnut shells, glass beads, sand, proprietary media or any other suitable cleaning media.

Figure 5:
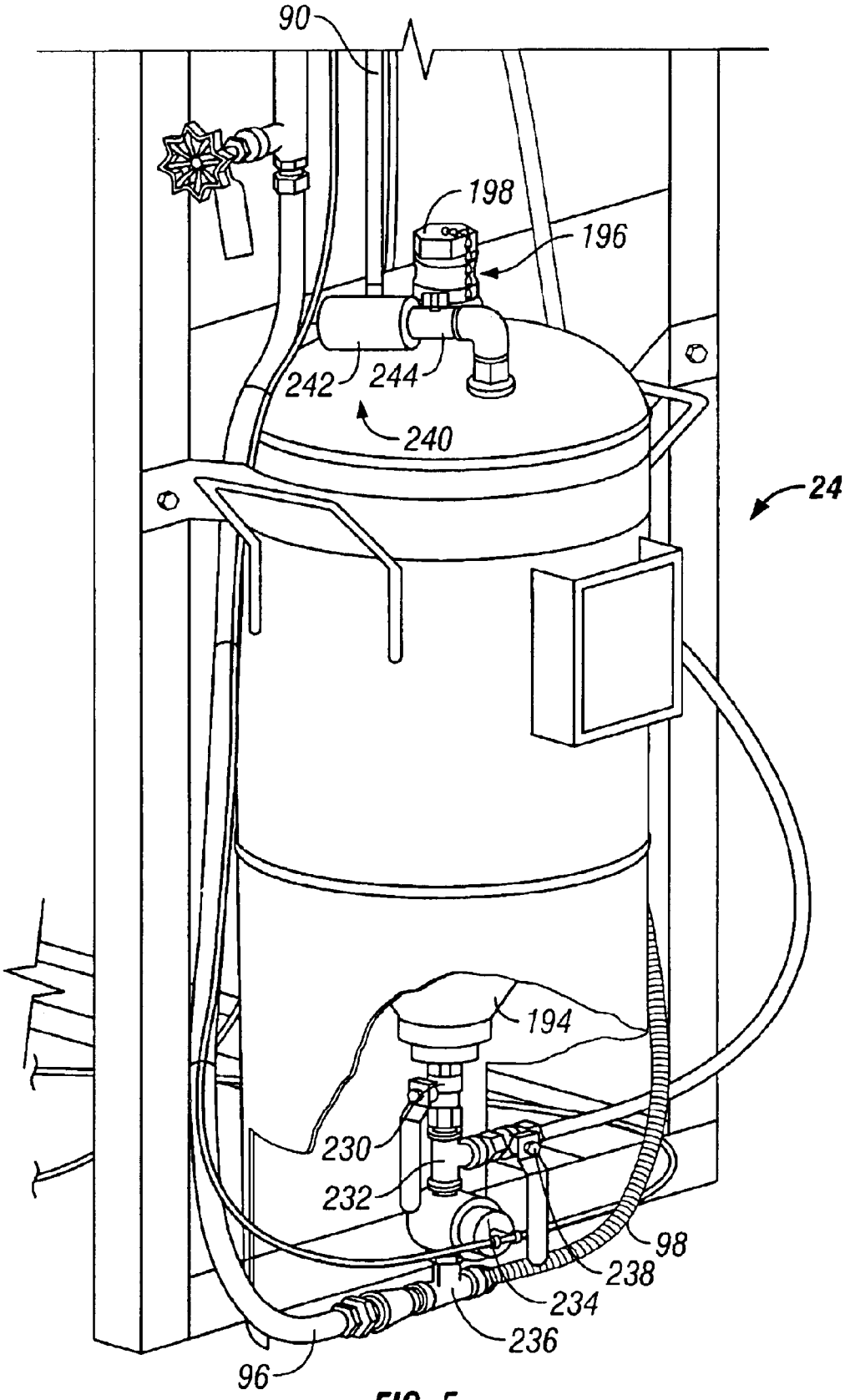
FIG. 5 is a detailed perspective view and partially broken away view of the delivery unit of the cleaning apparatus of FIG. 1.

FIG. 5 illustrates a detailed perspective view and partially broken away view of the delivery unit 24 of the cleaning apparatus of FIG. 1. The delivery unit 24 includes a container 194 for the cleaning media, a refill port 196 and a safety device 198 operatively connected to the refill port 196 for relieving pressure in the container 194 as will be discussed in detail below. The refill port 196 is adapted for operative connection to a media source for refilling the cleaning media as will be discussed in detail below.

Figure 7:
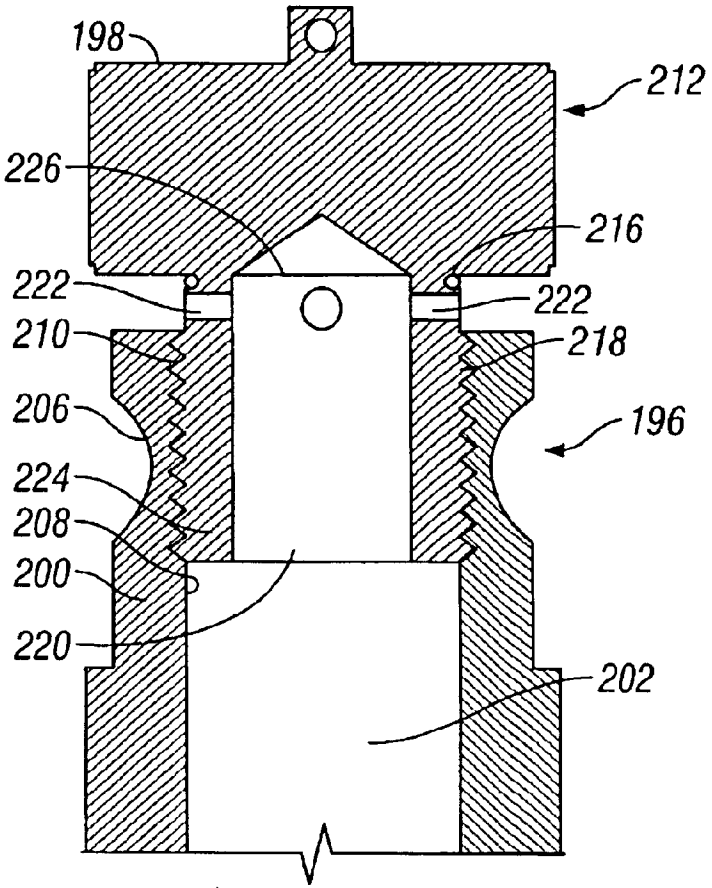
FIG. 7 is a cross sectional view of the refill port and safety device of FIG. 6.
Figure 6:
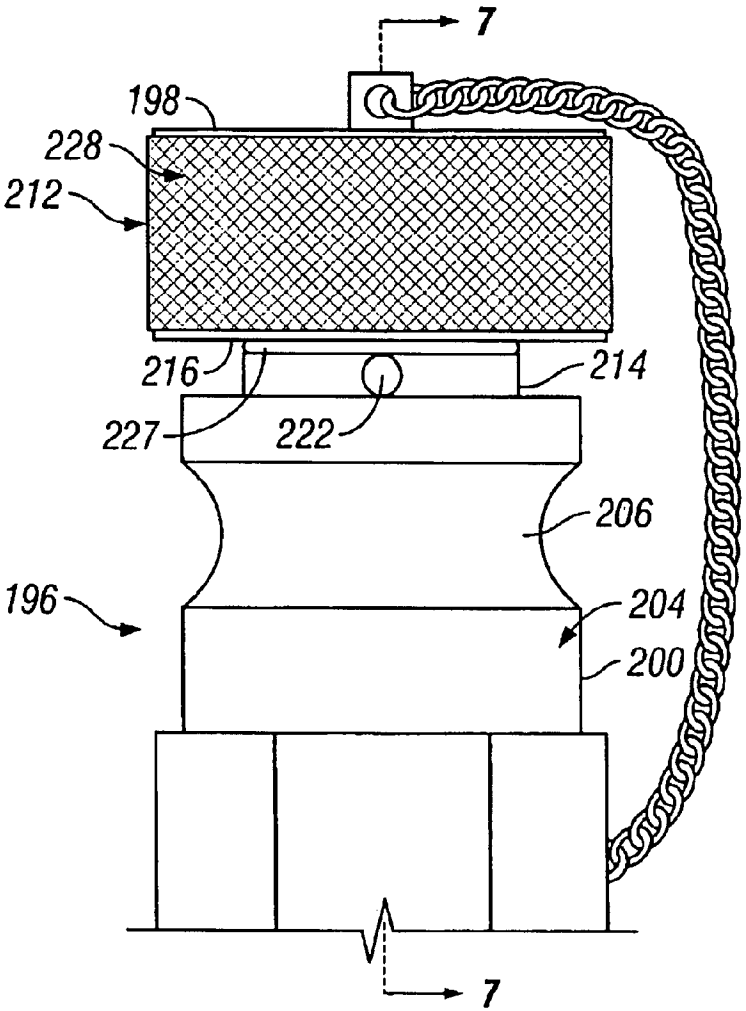
FIG. 6 is a detailed front elevation view of the refill port and safety device of the cleaning apparatus of FIG. 1.

As shown in detail in FIGS. 6 and 7, the refill port 196 includes a wall 200 configured to define a bore 202. The wall 200 has an outer surface 204 including a coupling element 206 formed thereon. The wall 200 further includes an inner surface 208 including a first connection element 210 formed thereon.

In this embodiment of the present invention, the refill port 196 is configured as a male cam lock fitting. It is within the teachings of the present invention that any other suitable coupling element may be formed on the refill port 196 for operative connection to a conduit for refilling the container.

The safety device 198 includes a head 212 and a shaft 214 extending from the head 212 at a shoulder 216. The shaft 214 includes a second connection element 218 complementary to the first connection element 210 for operative engagement therebetween. Moreover, the shaft 214 further includes a bore 220 and at least one vent 222 formed therein. The bore 220 extends through the shaft 214 from a free end 224 to an inner end 226 adjacent the shoulder 216. Each at least one vent 222 is disposed adjacent the inner end 226 and extends from the bore 220 through the shaft 214. The safety device 198 relieves pressure in the container when the safety device 198 is partially disengaged from the refill port 196 such that at least one vent 222 is exposed to enable communication between the pressurized container and an environment exterior of the safety device 198.

In one embodiment of the present invention, the first and second connection elements 210, 218 are configured as conventional screw threads. However, it will be recognized by one of skill in the art that other suitable connection elements may be used to achieve the same function.

In one embodiment of the present invention, the safety device 198 further includes a gasket 227 disposed adjacent the shoulder 216 to seal an interface between the safety device 198 and the refill port 196. It will be recognized by one of skill in the art that the gasket 227 may be formed from any elastomeric material which provides suitable sealing qualities. For example, the gasket may be formed of rubber, nylon or any other suitable material.

In one embodiment of the present invention, the head 212 of the safety device 198 further includes a grip enhancing feature 228 which may be formed by knurling the surface of the head 212 or by configuring the head 212 such that a plurality of flat surfaces are disposed about the circumference of the head 212 normal to a longitudinal axis of the shaft 214.

In one embodiment of the present invention, each at least one vent 222 is configured such that relieving pressure therethrough generates an audible tone indicative of such pressure relief. It will be recognized by those of skill in the art that differently configured vents will generate different audible tones.

The bore 220 is in communication with the container at its free end and with the perpendicularly aligned vents 222 extending through the shaft 218 disposed adjacent the shoulder 216.

During normal parts cleaning operations, the safety device 198 is operatively connected to the refill port 196 and compressed air from hose 90 pressurizes the container 194 in order to maintain the system pressure of approximately a minimum of twenty to a maximum of ninety pounds per square inch. During service when cleaning media must be added to the container 194, the system must be depressurized, preferably using a dedicated vent valve. The safety device 198 may then be removed. In the event an operator fails to properly depressurize, or if there is residual pressure, the safety device vents 222 relieve the pressure remaining in the container 194 to the atmosphere before the safety device 198 can be fully removed.

In connection with the discussion above, with respect to FIG. 5 a ball valve 230 is connected to an outlet port of the container 194 in order to control discharge of the cleaning media from the container 194. As shown, the cleaning media passes through the ball valve 230 and a T-fitting 232. If the cabinet interlock switch and foot switch are actuated, control valve 234 opens so that the cleaning media may flow there through into another T-fitting 236. Compressed air available in hose 96 moves the cleaning media through hose 98 into the cleaning chamber for use in the cleaning process.

When the cleaning apparatus is operating substandard because of a restriction, or is scheduled for maintenance, the ball valve 230 is closed and ball valve 238 is moved to the open position so that compressed air via hose 74 may be used to purge the cleaning media from hose 98.

The delivery unit 24 further includes a vacuum port 240 which includes a fitting 242 and a valve 244 for use in connection with a media transfer mode which will be discussed in detail below.

Figure 8:
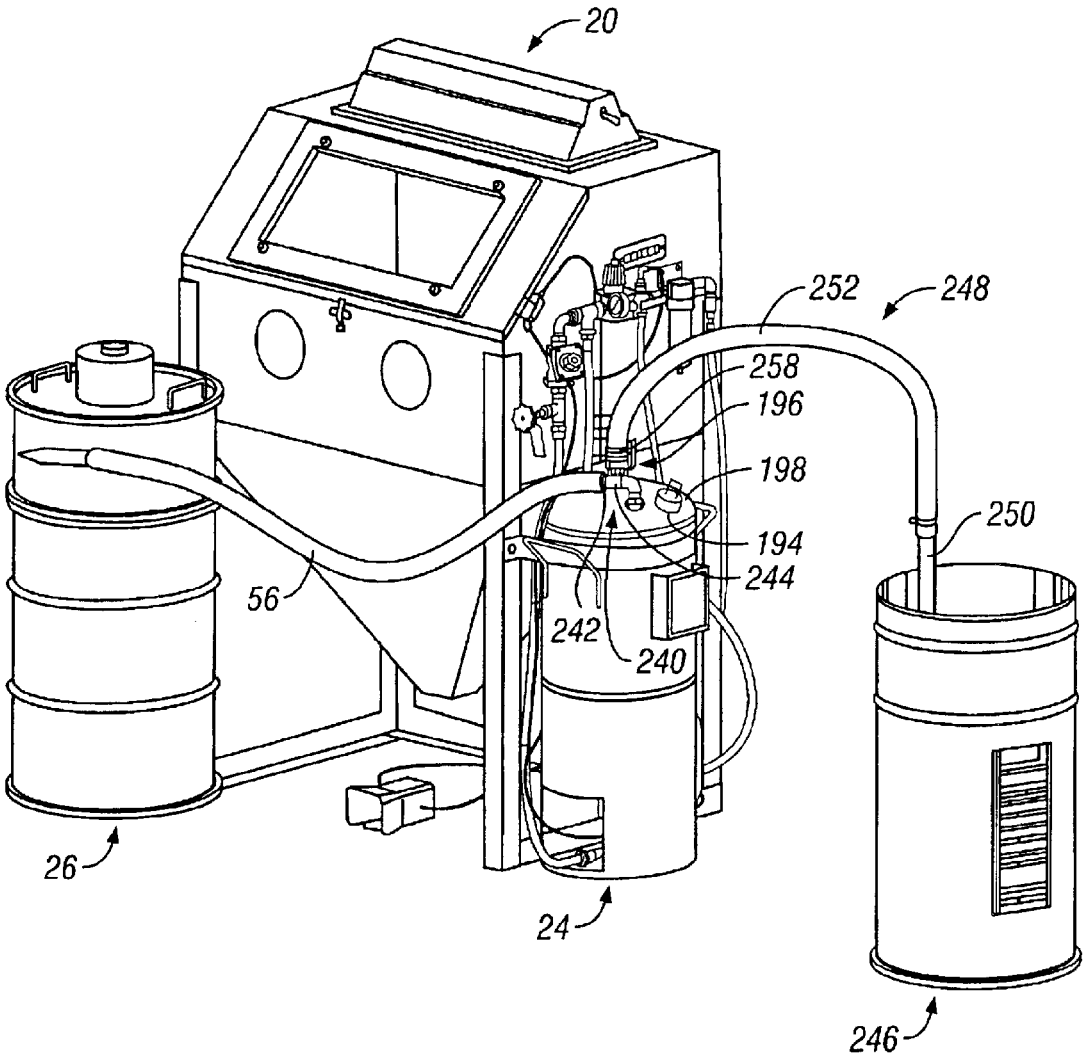
FIG. 8 is a perspective view of the cleaning apparatus of FIG. 1 configured in a media transfer mode.

FIG. 8 illustrates a perspective view of the cleaning apparatus 20 of FIG. 1 configured in a media transfer mode. In this configuration, bulk cleaning media is transferred from a cleaning media source 246 to the delivery unit 24. The delivery unit 24 includes a container 194 having a refill port 196 and a vacuum port 240. The delivery unit further includes a safety device 198 operatively connected to the refill port 196 for relieving pressure in the container when the safety device 198 is partially disconnected from the refill port 196 as discussed in detail above. A conduit 248 operatively connects the cleaning media source 246 to the refill port 196 after the safety device 198 has been removed.

A vacuum source is operatively connected to the vacuum port 240. In this embodiment of the present invention, the evacuation device 26 functions as the vacuum source. The hose 56 is removed from the outlet 54 and reconnected to the fitting 242 of the vacuum port 240. Upon opening the valve 244 in the vacuum port 240, a vacuum generated by the vacuum source 26 draws cleaning media from the cleaning media source 246 through the conduit 248 and refill port 196 into the delivery unit 24. The evacuation device 26, when operational in the media transfer system, creates a continuous vacuum in the range of 100–110 cubic feet per minute.

In one embodiment of the present invention, the conduit 248 includes a standpipe 250 and a flexible tubular conduit 252 attached thereto. The standpipe 250 includes a filtering device (not shown) disposed at an end thereof for filtering large particles or debris that may clog the systems during operation. A female cam lock fitting 258 is connected to an end of the flexible tubular conduit 252 opposite the standpipe 250. The female cain lock fitting 258 locks on to the refill port 196 by complimentary engaging the coupling contour. Upon insertion of the standpipe 250 into the cleaning media source 246, bulk cleaning media is transferred from the cleaning media source 246 to the delivery unit 24. In this manner, bulk cleaning media is transferred quickly without creating nuisance dust as is the result when using other prior art methods. Preferably, a clear section of hose is disposed adjacent the vacuum port fitting 242 to provide a sight hole for determining when the delivery unit is full of cleaning media.

Figure 9:
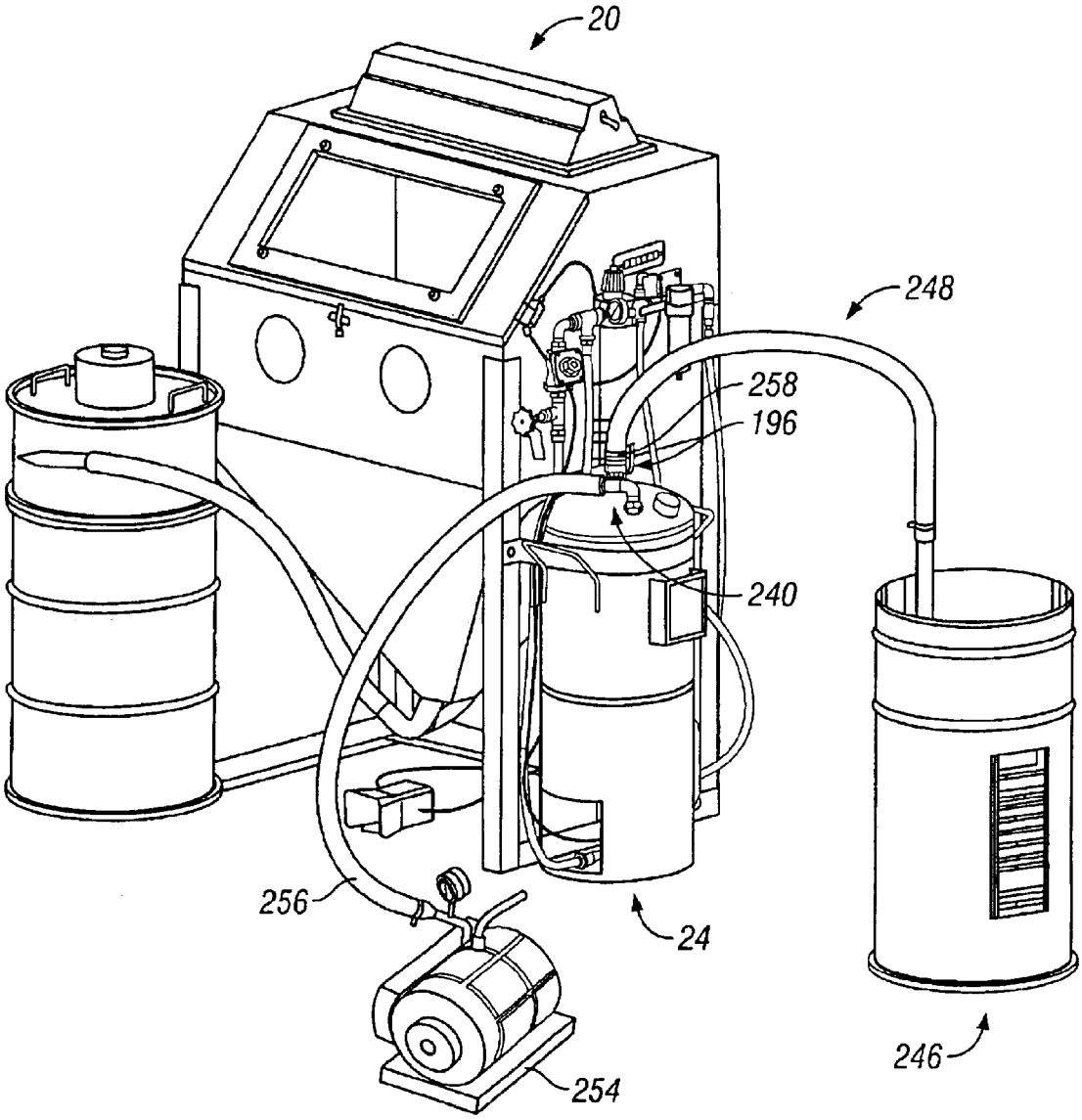
FIG. 9 is a perspective view of the cleaning apparatus of FIG. 1 configured in an alternative media transfer mode.

FIG. 9 illustrates a perspective view of the cleaning apparatus 20 of FIG. 1 configured in one alternative media transfer mode. This embodiment of the present invention is identical to the embodiment described with respect to FIG. 8 except for the following elements and limitations. The vacuum source in this embodiment of the present invention is a vacuum pump 254 which is in communication with the vacuum port 240 via hose 256. In this configuration, air is evacuated from the delivery unit 24 by the low cfm vacuum pump 254 which creates a continuous vacuum in the range of one to two cubic feet per minute. Again, the continuous vacuum created by the vacuum pump 254 in the delivery unit 24 draws the cleaning media from the cleaning media source 246 through the conduit 248 and refill port 196 quickly without creating nuisance dust. This embodiment of the present invention will fill the delivery unit 24 to the required level automatically such that a weighing device is not required.

The embodiments described above are illustrative and not restrictive. A scope of the invention is indicated by the claims rather than the foregoing description. The invention has been described in all foreseeable embodiments. Accordingly, all changes which come within the scope of the claims are intended to be embraced therein.

What is claimed is:

1. An apparatus for a cleaning process, comprising:

a cabinet operatively connected to a delivery unit for storing and supplying cleaning media and an evacuation device for collecting used cleaning media and debris generated during the cleaning process;

the cabinet including a support structure, and a plurality of panels defining a cleaning chamber and a hopper separated by a shelf;

one of the plurality of panels configured as an access panel including a viewing aperture and at least one port formed adjacent the viewing aperture;

a cover including a transparent element and an overhanging portion;

the cover removably connected to the access panel such that the transparent element is aligned with the viewing aperture to provide a line of sight;

a gasket disposed on the cover for contact with the access panel to seal an interface between the cover and the access panel;

the overhanging portion including an element discontiguous with the access panel which defines a gap when the cover is removably connected to the access panel;

wherein activation of the evacuation device during the cleaning process removes used cleaning media and debris from the cabinet by drawing air through the gap and each at least one port, whereby visibility along the line of sight is increased.

2. The apparatus as recited in claim 1, wherein the delivery unit comprises a container for cleaning media, which includes a refill port and a safety device operatively connected to the refill port for relieving pressure in the container; the refill port is adapted for operative connection to a media source for refilling the cleaning media; the refill port includes a wall configured to define a bore; the wall having an outer surface including a coupling element formed thereon; the wall having an inner surface including a first connection element formed thereon; the safety device including a head and a shaft extending from the head at a shoulder; the shaft including a second connection element complimentary to the first connection element for operative engagement therebetween; a bore and at least one vent; the bore extends through the shaft from a free end of the shaft to an inner end adjacent the shoulder; each at least one vent is disposed adjacent the inner end and extends from the bore through a wall of the shaft; wherein the safety device relieves pressure in the container when the safety device is partially disengaged from refill port such that each at least one vent is exposed to enable communication between the pressurized container and an environment exterior of the safety device.

3. The apparatus as recited in claim 2, wherein the refill port is configured as a male cam lock fitting.

4. The apparatus as recited in claim 2, wherein the first and second connection elements are screw threads.

5. The apparatus as recited in claim 2, further including a gasket disposed adjacent the shoulder to seal an interface between the safety device and the refill port.

6. The apparatus as recited in claim 2, wherein the head further includes a grip enhancing feature.

7. The apparatus as recited in claim 2, wherein the grip enhancing feature includes a knurled surface.

8. The apparatus as recited in claim 2, wherein the grip enhancing feature includes a plurality of flat surfaces normal to a longitudinal axis of the shaft.

9. The apparatus as recited in claim 2, wherein each at least one vent is configured to generate an audible tone responsive to relieving pressure through the vent.

10. The apparatus as recited in claim 1, wherein the cover further includes a diverter channel in communication with each at least one port for redirecting air drawn into the cabinet across the transparent element.

11. A blast cabinet cleaning apparatus including a delivery unit, said delivery unit comprising:

a container for cleaning media which includes a refill port and a safety device;

the safety device operatively connected to the refill port for relieving pressure in the container;

the refill port adapted for operative connection to a media source for refilling the container with cleaning media;

the refill port including a wall configured to define a bore;

the wall having an outer surface including a coupling element formed thereon;

the wall having an inner surface including a first connection element formed thereon;

the safety device including a head and a shaft extending from the head at a shoulder;

the shaft including a second connection element complimentary to the first connection element, a bore and at least one vent;

the bore extends through the shaft from a free end of the shaft to an inner end adjacent the shoulder;

each at least one vent disposed adjacent the inner end extending from the bore through a wall of the shaft;

wherein the safety device relieves pressure in the container when the safety device is partially disengaged from the refill port such that each at least one vent is exposed to enable communication between the pressurized container and an environment exterior of the safety device.

12. The apparatus as recited in claim 11, wherein the refill port is configured as a male cam lock fitting.

13. The apparatus as recited in claim 11, wherein the first and second connection elements are screw threads.

14. The apparatus as recited in claim 11, further including a gasket disposed adjacent the shoulder to seal an interface between the safety device and the refill port.

15. The apparatus as recited in claim 11, wherein the head further includes a grip enhancing feature.

16. The apparatus as recited in claim 11, wherein the grip enhancing feature includes a knurled surface.

17. The apparatus as recited in claim 11, wherein the grip enhancing feature includes a plurality of flat surfaces normal to a longitudinal axis of the shaft.

18. The apparatus as recited in claim 11, wherein each at least one vent is configured to generate an audible tone responsive to relieving pressure through the vent.

19. A blast cabinet cleaning apparatus including a media transfer system for refilling a delivery unit, said media transfer system comprising:

a cleaning media source;

the delivery unit including a container having a refill port and a vacuum port;

the delivery unit further including a safety device operatively connected to the refill port for relieving pressure in the container when the safety device is partially disconnected from the refill port;

a conduit operatively connecting the cleaning media source to the refill port after the safety device has been removed;

a vacuum source operatively connected to the vacuum port;

wherein, a vacuum generated by the vacuum source draws media from the media source, through the conduit and refill port and into the delivery unit.

20. The apparatus as recited in claim 19, wherein the vacuum source is an evacuation device for collecting used cleaning media.

21. The apparatus as recited in claim 19, wherein the vacuum source is a vacuum pump.

22. The apparatus as recited in claim 19, wherein the cleaning media source includes a bulk container of cleaning media.

23. The apparatus as recited in claim 19, wherein the conduit includes a standpipe for insertion into a bulk container of cleaning media.

24. An apparatus for a cleaning process, comprising:

a cabinet operatively connected to a delivery unit for storing and supplying cleaning media and an evacuation device for collecting used cleaning media and debris generated during the cleaning process;

the evacuation device including a base container, a transition collar and a power head assembly;

the base container including a bottom and a wall extending upwardly from a perimeter of the bottom;

the transition collar including an air inlet port operatively in fluid communication with the cabinet and operatively connected to the base container;

the power head assembly operatively connected to the transition collar including a cover assembly, a filter and a conical element;

the cover assembly including a lid, a motor connected to one side of the lid and a blower connected to another opposite side of the lid;

the filter connected to the blower;

the conical element including a sidewall, a bottom wall and a mounting flange which cooperatively define a receptacle for receiving the filter;

the bottom wall including an aperture formed therein to define passageway for air;

the mounting flange including a plurality of apertures for connecting the conical element to the blower;

wherein, activation of the motor moves the blower to generate a vacuum in the evacuation device such that air, used cleaning media and debris is drawn through the air inlet port and continues to move in a cyclonic motion within the base container about the conical element so that the used cleaning media and debris are disposed about the perimeter of the base container bottom wall and the air is drawn through the aperture and the filter for discharge to the atmosphere.

25. The apparatus as recited in claim 24 wherein the air inlet port is tangential.

26. The apparatus as recited in claim 24 wherein a bolt-ring assembly connects the transition collar to the base container and the power head assembly.

27. The apparatus as recited in claim 24, wherein a gaslut is disposed between the transition collar and the base container and the power head assembly to seal the evacuation device.

* * * * *